US006193573B1

(12) United States Patent
Small

(10) Patent No.: US 6,193,573 B1
(45) **Date of Patent: *Feb. 27, 2001**

(54) AIR INDUCTION SYSTEM FOR TUNNEL MOUNTED SURFACE PIERCING PROPELLERS

(76) Inventor: Mark S. Small, 5067 Garfield Rd., Delray Beach, FL (US) 33484

( * ) Notice: Subject to any disclaimer, the term of this patent is extended or adjusted under 35 U.S.C. 154(b) by 0 days.

This patent is subject to a terminal disclaimer.

(21) Appl. No.: 09/469,093

(22) Filed: Dec. 21, 1999

Related U.S. Application Data

(63) Continuation-in-part of application No. 09/233,505, filed on Jan. 19, 1999, now Pat. No. 6,045,420.

(51) Int. Cl.[7] ..... B63H 5/16

(52) U.S. Cl. ..... 440/69

(58) Field of Search ..... 440/66, 67, 69, 440/68, 70, 89; 114/288

(56) References Cited

U.S. PATENT DOCUMENTS

| | | | | |
|---|---|---|---|---|
| 4,689,026 | * | 8/1987 | Small | 440/69 |
| 4,941,423 | * | 7/1990 | Van Tassel | 440/69 |
| 6,045,420 | * | 4/2000 | Small et al. | 440/69 |

* cited by examiner

*Primary Examiner*—Ed Swinehart
(74) *Attorney, Agent, or Firm*—McHale and Slavin

(57) ABSTRACT

The instant invention is directed toward a marine craft having a semi-enclosed surfacing type propeller in a tunnel that draws air through specific areas located and shaped to enhance performance and compensate for prime mover torque and horsepower characteristics. The invention further relates to the field of marine water craft, particularly to high speed power boats utilizing a surface piercing propeller drive system mounted within a propeller tunnel formed integral to the hull of the boat, and most particularly to inclusion, within a wall of said tunnel, of a means for providing air thereto; said means being judiciously placed for linearization of the relationship between vessel velocity and engine speed.

9 Claims, 12 Drawing Sheets

45 ISLAND WORLD II

FIG. 15

BASE CONDITIONS: ENGINE WITH POOR LOW ENG(EG.TURBOCHARGED), DWL ABOVE FEATURE 30

| CHARATERISTIC → / FEATURE/RANGE | TUNNEL VAC-WOT** | ACCEL | WOT MPH | OVERLOAD ENGINE IN ROUGH SEA | RUNAWAY IN TURNS | PROP CAVITATION | REVERSE THRUST |
|---|---|---|---|---|---|---|---|
| 40/TOO SMALL | HIGH | SLOW | SLOW | YES | NO | | |
| 40/CORRECT | CORRECT | GOOD | GOOD | NO | NO | | |
| 30/NONE | MINOR EFFECT | POOR | MINOR EFFECT | NO | NO EFFECT | | |
| 30/CORRECT | IMPROVED | GOOD | IMPROVED | RELIEF | NO EFFECT | | |
| 44/NONE | NO EFFECT | POOR | NO EFFECT | RELIEF | POSSIBLE | | |
| 44/CORRECT | NO AFFECT | GOOD | NO EFFECT | ELIMINATED | NONE | | |
| 42/TOO SMALL | HIGH | POOR | LOW | YES | NO | | |
| 42/CORRECT | CORRECT | GOOD | GOOD | NO | NO | | |
| 34/TOO LOW | NO EFFECT | POOR | GOOD | YES | NO | | |
| 34/CORRECT | CORRECT | GOOD | GOOD | NO | NO | YES | POOR |
| Y DIMENSION-TO LARGE | LITTLE EFFECT | NONE | SLOW | NO | NO | SOME | OK |
| Y DIMENSION-CORRECT | LITTLE EFFECT | GOOD | GOOD | NO | NO | OK | GOOD |
| Y DIMENSION-TOO SMALL | LITTLE EFFECT | SLOW | EXCELLENT | YES | YES | OK | GOOD |
| AREA 14 TOO LARGE | | | | | | | POOR |
| AREA 14 CORRECT | | | | | | | GOOD |
| AREA 14 TOO SMALL | VERY HIGH | POOR | POOR | YES | | OK | EXCELLENT |

** HIGH VALUE DECREASES SPEED

AIR INDUCTION SYSTEM FOR TUNNEL MOUNTED SURFACE PIERCING PROPELLERS

REFERENCE TO RELATED APPLICATIONS

This application is a Continuation-in-Part of Ser. No. 09/233,505, filed on Jan. 19, 1999, U.S. Pat. No. 6,045,420 the contents of which are herein incorporated by reference.

FIELD OF THE INVENTION

The present invention relates to the field of marine water craft, particularly to high speed power boats utilizing a surface piercing propeller drive system mounted within a propeller tunnel formed integral to the hull of the boat, and most particularly to inclusion, within a wall of said tunnel, of a means for providing air thereto; said means being judiciously placed for linearization of the relationship between vessel velocity and engine speed.

BACKGROUND OF THE INVENTION

Surface piercing drive technology and propeller tunnels are an established art which the inventor helped pioneer having been awarded U.S. Pat. No. 4,689,026, the contents of which are incorporated herein by reference. The drive systems can be highlighted by their ability to provide enhanced boat performance by use of the surface piercing propellers while safely placing such propellers beneath the hull of the water craft.

The obvious disadvantages of the surface piercing propellers may be found in reference to U.S. Pat. No. 5,667,415 issued to Arneson. The surfacing propeller is well known for its speed, as well as its lack of thrust at low speed, overloading its power source at preplane speeds and low thrust in reverse. Arneson has successfully commercialized surface piercing propellers which position a propeller near the surface of the water at a location outward from the transom of a boat. Air is drawn into and through the propellers and through the principles of compression/cavitation the propeller is able to function according to its design characteristics, thus leading to enhanced speed and performance derived from the surface piercing technology. Disadvantages to the surface piercing technology are mainly directed to the location of the propeller which is typically at the back of the boat. This interferes with the use of the back of the boat for fishing, diving or swimming and exposes the propeller to a position that is most dangerous. Representative disclosures relating to surface piercing technology can be found in U.S. Pat. Nos. 4,645,463 and 4,909,175.

Other disadvantages are the need to rotate the drives since they operate as a rudder and the inability to operate such drive systems at low speed which became the subject of the Arneson U.S. Pat. No. 5,667,415 previously mentioned. In this registration the invention discloses the use of a shroud that is placed around the propeller which prevents "walking" of the propeller at low speed but also protects individuals or marine life from impacting the propellers.

The directing of air to the propeller while it is beneath the boat provides a known benefit and is the subject of various types of prior art such as the following: U.S. Pat. Nos. 2,434,700; 3,702,485; U.S. Pat. No. Re. 23,105; U.S. Pat. No. Re. 38,522; U.S. Pat. Nos. 130,391; 807,769; 815,270; 1,081,876, 1,117,357; 1,262,942; 1,401,963; 2,138,831; 3,450,090; 4,031,846; 4,363,630; 4,383,828; 22,080; 965, 870, 1,916,597; 1,966,029; 3,793,980; 3,937,173; 4,300, 889; 4,443,202; 5,141,456; 5,405,278; 5,171,175; 5,667, 415; 5,679,037; 4,977,845; 4,371,350; 4,993,349; 5,482, 482; 5,588,886; and 4,941,423.

What is lacking in the art is the teaching of a surface drive technology that forms air passageways that enhance surface piercing propeller operation at all speeds and conditions and that particularly provides for a linearization of the relationship between vessel velocity and engine speed.

SUMMARY OF THE INVENTION

The present invention is directed to marine vessels having a surface piercing propeller(s) in a defined enclosure. In its simplest form, the present invention provides at least one surface piercing propeller positioned within a depression, termed a tunnel, formed within the vessel's hull, which tunnel has at least one surface or wall which runs generally parallel to a longitudinal axis of said vessel and is contiguous with a bottom side of said hull and a top side of said tunnel. The wall contains at least one opening through which air is supplied. This opening is placed so as to be gradually uncovered from water as the vessel's forward speed increases. Judicious placement of the opening enables the relationship between the vessel's velocity and the engine speed to define and maintain an essentially linear relationship as the vessel accelerates from rest to its maximum velocity and during the transition from displacement mode to planing mode.

In a further embodiment, the configurations define an air induction system that allows each of the critical performance parameters to be optimized and controlled to suit the hull configuration to which it is applied. This air induction technique was developed because of the obvious advantages and disadvantages of current surfacing propeller drive systems. It was observed that the characteristics of surfacing propellers and the engines used to drive them suffered compatibility problems in their current applications. This observation lead to the need to identify and control critical design elements. The design of surfacing propellers, per se, relies upon very refined science; however their incorporation with a particular hull design requires that a degree of intuitive art be applied. The engines must follow the laws of thermodynamics and be operated in a cost effective manner; thus their operating characteristics are considered a given. In order to make the technologies compatible, it is critical that the interrelationship of their operational parameters be understood. The prior art either completely fails to address the control of air, or the mechanisms that have been employed are cumbersome and require constant operator intervention. This invention recognizes and discloses the relationship between efficient engine operation and air requirements of surface piercing propellers, and provides a method of application of this technology which results in enhanced operation of both the surfacing propeller and its prime mover.

Previous techniques have merely addressed the requirement for air, but have failed to appreciate either the need to control the amount of air supplied or the criticality of timing to the air supply/propeller relationship. The application of the parameters described herein provides the propeller with the environment required by a surfacing propeller. Engine characteristics can be compensated for by using these propeller to air relationships to assist the engine in attaining its torque and rpm design targets. The uniqueness of this invention is that it requires no moving parts, controls or operator intervention. The ability to vary the amount and timing of air to the propeller is achieved by the shape and location of the air induction system, in combination with the nature of water flow and the natural angle change that a marine vessel goes through as it transitions from static to on plane speeds. These features are molded in surfaces of the hull and can be designed to expand the operating window of the vessels it is applied to. The operational characteristics that are gained are 1) seamless transition from idle to planing speed, 2) stable speed at any sea state and throttle setting, and 3) effective reverse with directional control.

The propeller enclosing tunnel may be a single surface or it may be defined by a series of surfaces, each of which provide an enhancement to the operation of the vessel. In particular, the top of the tunnel may be formed from a flat surface which is used for mounting the propeller strut and rudder. The flat surface also eliminates the need for different left and right strut fittings and provides a uniform surface for determination of propeller blade clearance.

A second surface may be formed angular to the first surface and positioned perpendicular thereto. The second surface enhances reverse thrust by deflecting prop wash and reducing the "damming" effect typical of a flat transom vessel. A third surface is in juxtaposition to the first surface and provides an angular wall at a right angle, shaped to shield the propeller from obtaining water during high speed acceleration. The aforementioned surfaces create an outer wall for the air tunnel used for transferring air from the transom to a position before the propeller. The angular wall of the tunnel includes a shaped opening that operates as a controlled air passageway to control the air in relation to water flow. This is shaped so as not to foul the air passageway during acceleration, low speed and/or rough sea conditions. However, as the boat accelerates the shaped passageway allows additional air to be transferred to the front face of the propeller. The tunnel and passageway is sized to the particular engine and hull characteristics so as to allow the engines to reach the optimum power curve for acceleration.

Thus, it is an objective of the instant invention to optimize the performance of surface piercing propellers placed beneath a boat.

It is a further objective of the instant invention to provide, in combination with a tunnel in the underside of the hull of a vessel, a means for providing air thereto; said means being judiciously placed for linearization of the relationship between vessel velocity and engine speed.

Yet another objective of the instant invention is to teach a particularly shaped enclosure which functions to control the timing and volume of air flow, in relation to the water flow, throughout the performance curve of the engine and to accommodate inept conditions during low speed operation, acceleration and/or rough sea conditions.

A still further objective of the instant invention is to provide a flat surface for mounting of the struts and rudder so as to eliminate the need for left or right version components.

Yet an additional objective of the instant invention is to provide a surface piercing propeller driven vessel having enhanced reverse thrust characteristics.

Still an additional objective of the instant invention is to correlate the design parameters of the shaped passageway in relation to engine and hull design to optimize boat performance by allowing the engine and hull to operate at optimum design characteristics.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 15 is a chart of air ingress optimization characteristics.

DETAILED DESCRIPTION OF THE PREFERRED EMBODIMENT

Figure 1:
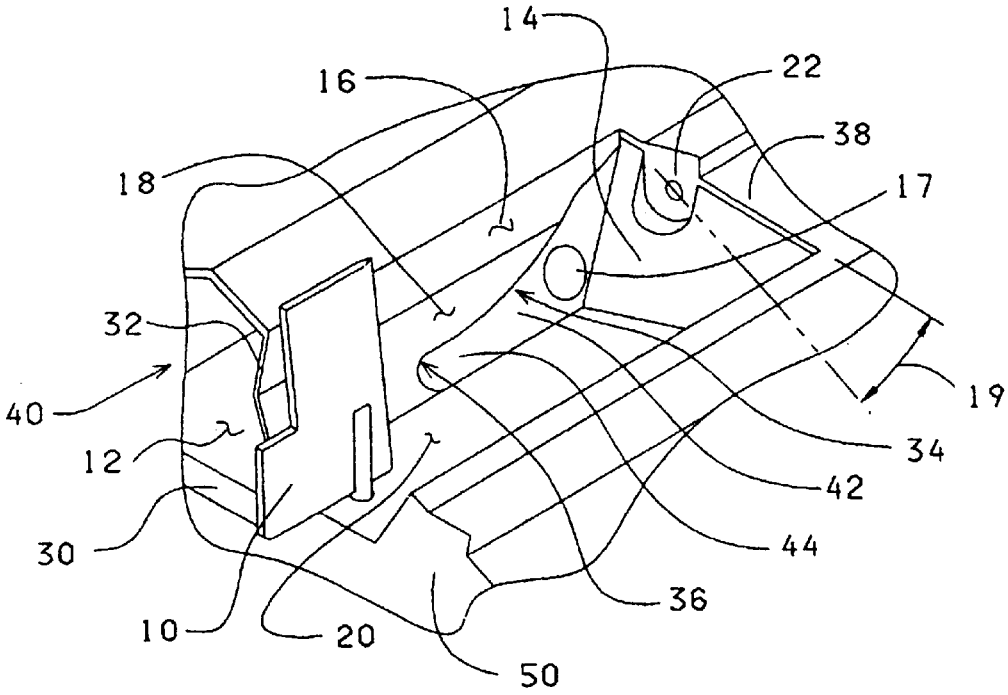
FIG. 1 is a close up of one side of FIG. 2 with the propeller and shaft removed for clarity.
Figure 2:
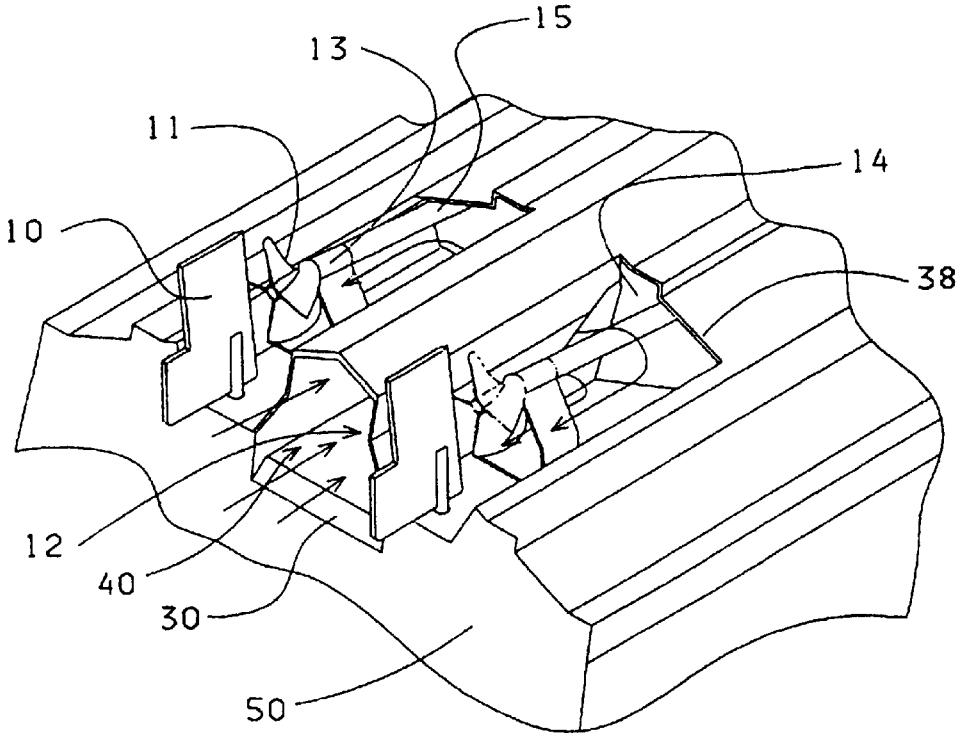
FIG. 2 is an upside down isometric view of the rear portion of a boat having twin surfacing propellers and tunnels.
Figure 6:
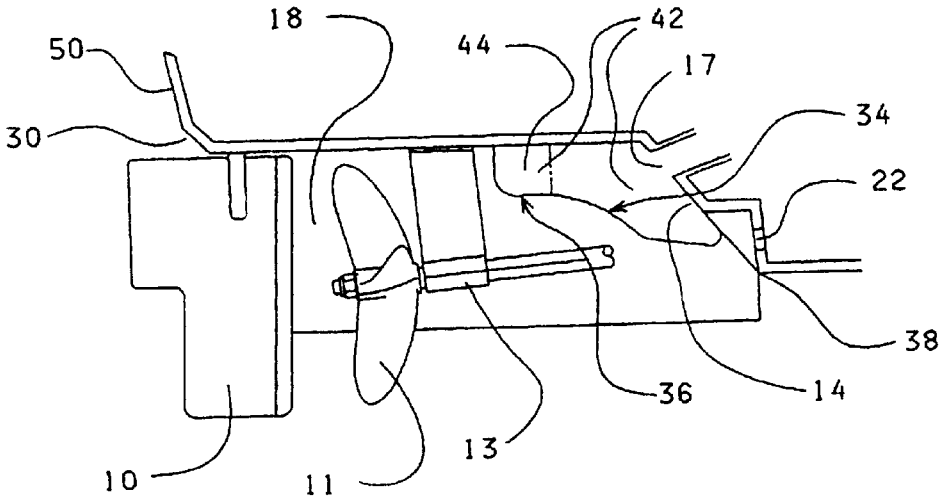
FIG. 6 is a rear section view of the stern portion of a boat having a surfacing propeller in a semi-enclosed tunnel.
Figure 7:
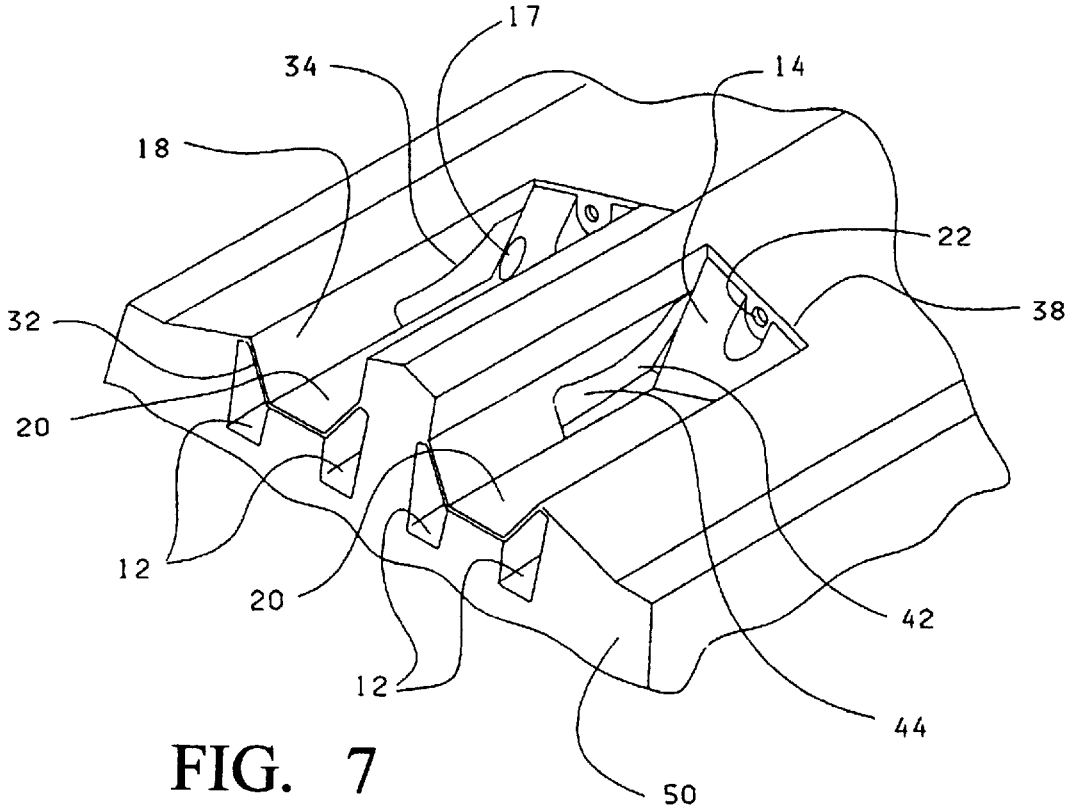
FIG. 7 is a rear section view of the stern portion of a boat having twin surfacing propellers in a semi-enclosed tunnel with all running gear removed.

Referring now to FIG. 1, an expanded partial view of the hull structure underside 8 inclusive of rudder 10 is shown. This area of the hull contains several surfaces 12,14,16,18, 20 and 22 which have been constructed and arranged so as to act in concert to yield optimum performance and handling characteristics to the vessel in all phases of operation. In contrast to prior art attempts, the surfaces of the instant invention provide abrupt transitions and sharply angled surfaces. This design provides enhanced operation and facilitates construction and manufacturing. Surface 12 defines the roof of the plenum area. Many installations allow this surface to be above the static water line. This surface can also be angled up from its starting point, intersection with surface 14, so as to provide easy escape of exhaust gases during conditions of full vessel load while the vessel is at rest. The angle is typically 1 to 2 degrees up from the static trim angle of the craft, however it is contemplated that this angle will be optimized in relation to the particular vessel. Surface 14 is designed to enhance reverse thrust by deflecting the propeller wash and thereby reducing the damming effect of the transom. This surface may be inclined along two angles. As best seen in FIG. 6, the first inclination, that of the top of surface 14 toward the aft or rear of the vessel, encourages reverse prop wash to continue past the cutwater 38. Referring again to FIG. 1, it can be seen that the defined angle 19, which is skewed from a plane parallel to transom 50, will divert the rearward propwash in a manner that will encourage reverse and side maneuvering. Surfaces 16 and 18 have a two-fold purpose. Firstly, they define the vent wall that provides air to the propeller. Secondly, they act as a shield to limit the amount of water which reaches the propeller during acceleration and high speed operation. Surface 20 provides a flat surface which is parallel to the keel of the craft. This surface provides a consistent surface in the hull, independent of the number of drive systems, on which to mount a universal strut assembly 13 for support of the drive shaft. This approach allows economy of scale in its use of a common strut assembly for all installations of a particular class. Surface 22 provides a flat stable surface perpendicular to the shaft angle, which is convenient for mounting the shaft seal assembly of choice (not shown).

Further referring to FIG. 1,2,6 and 7, several design features cooperate with the surface geometry so as to provide enhanced operating characteristics. Feature 30 enhances early air entry and exhaust percolation, although in many instances exhaust percolation is avoided by placing the surface 32 above the static water line. Feature 32 is judiciously placed so as to optimize the volume and timing of air entry to open area 40. Area 40 is the entry to the main plenum (plenums)and is sized in accordance with such features as hull weight, horsepower and target speed. This overall open area can be predicted by the following formula:

$$\text{Area } \mathbf{40} \text{ (per propeller)}=((\text{Area } \mathbf{11}\times 0.5)+\text{Area } \mathbf{54})\times 0.9$$

where area 11 equals the surface area of the propeller and area 54 is the area between the propeller and the vent walls. This design feature must be judiciously positioned so as to prohibit propwash from reducing the timing and volume to open area 40 while simultaneously permitting enhanced high speed turning and reverse thrust.

Referring to FIG. 6, feature 34 is critical to controlling the flow of water as it passes this region. Appropriate positioning of this feature will insure cooperation with open area 42 so as to prevent water fouling of the inlet air stream moving there through. Area 42 provides the primary air supply to the propeller and is sized so as to allow attainment of maximum speed while preventing fouling by passing water. This over all open area can be predicted by the formula:

$$\text{Area } \mathbf{42}=\text{Area } \mathbf{40}$$

Feature 36 provides a control area for early air induction into area 44, which is approximately 15% of area 42. This is sized so as to allow the propeller to reduce loading while the engine achieves its usable torque and rpm range. Judicious placement of this feature prevents water from fouling vent area 42 while at the same time limiting over ventilation. Feature 38 defines the cutwater. The placement of this feature is dictated by the hull design and represents the point at which the water detaches from the hull during high speed operation. Determining this feature is necessary in order to properly control propeller immersion.

Figure 3:
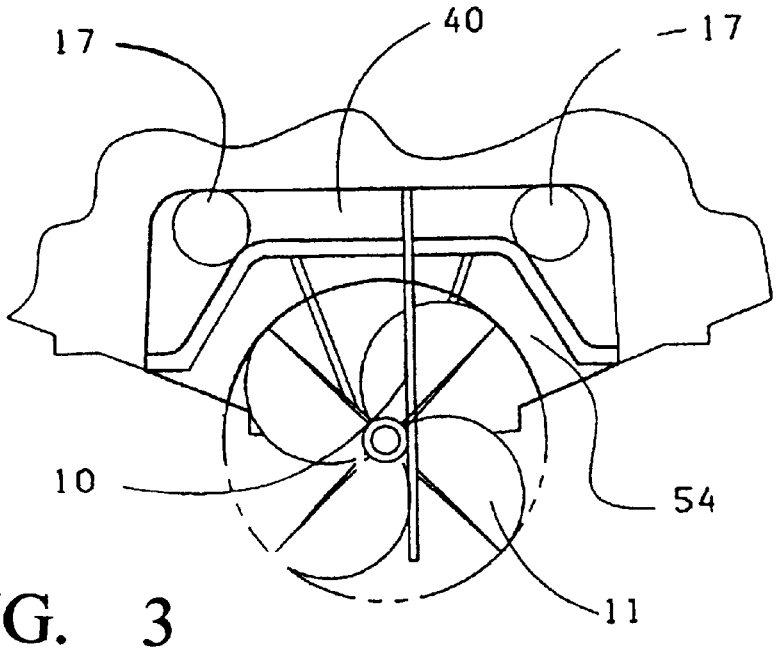
FIG. 3 is a stern view showing a common venting approach for a single propeller boat having a surfacing propeller semi-enclosed in a tunnel.
Figure 4:
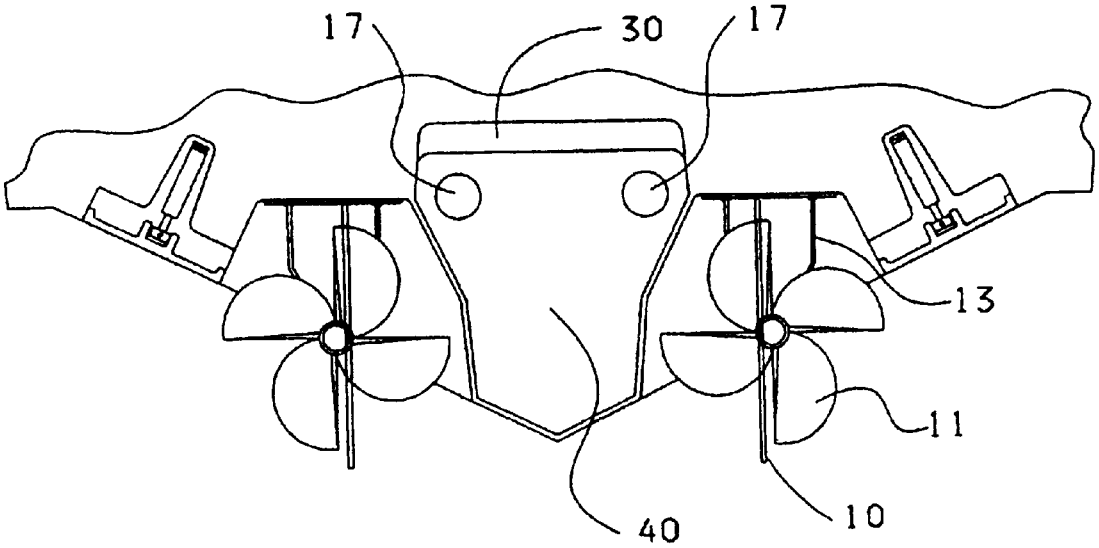
FIG. 4 is a stern view showing a common approach for twin propeller boats having a surfacing propeller semi-enclosed in a tunnel.
Figure 5:
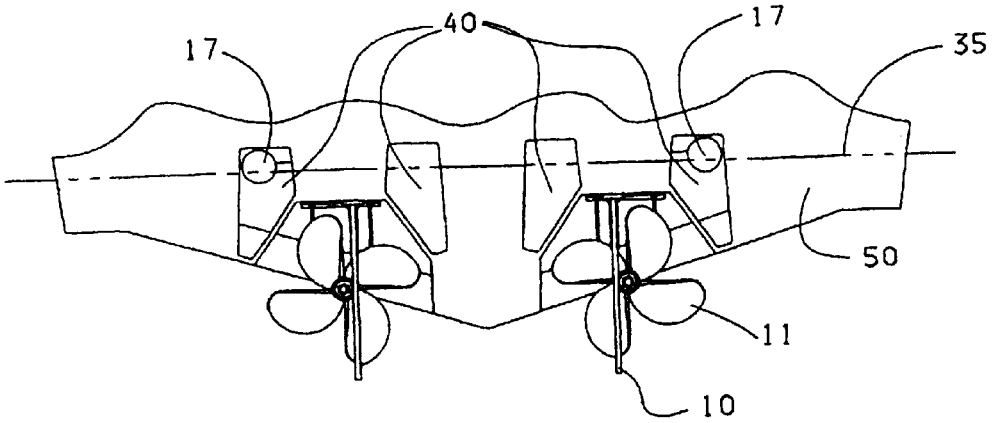
FIG. 5 is a stern view showing a common approach for twin propeller boats having a surfacing propeller semi-enclosed in a tunnel.

Referring to FIG. 3 a rear view of the transom 50 is shown. The area 54 is the area between the propeller and the vent walls. This must be kept to a minimum to insure optimum performance and limit the required size for area 40 and 44. The size of area 40 and 44 is a direct function of area 54 and will increase as area 54 increases. Location 17 is the exhaust outlet for the prime mover. This location is specific in that it is positioned in such a manner that the exhaust has free access to ambient air via plenum (plenums) 40 in static condition yet the forward action of the craft movement will draw the exhaust through area 42 and entrain the smoke and smell of the exhaust with the propwash.

FIGS. 8–12 are drawn to various embodiments illustrative of a simplified tunnel construction in stepped or non-stepped hulls, and are further inclusive of a means for air ingress. It is emphasized that these embodiments are merely illustrative of hull design and are not intended to be limited to any particular hull configuration. As will be hereafter described, the figures depict various combinations of 1)engine operation, 2)vessel velocity and 3)propeller orientation relative to the water's surface.

Figure 13:
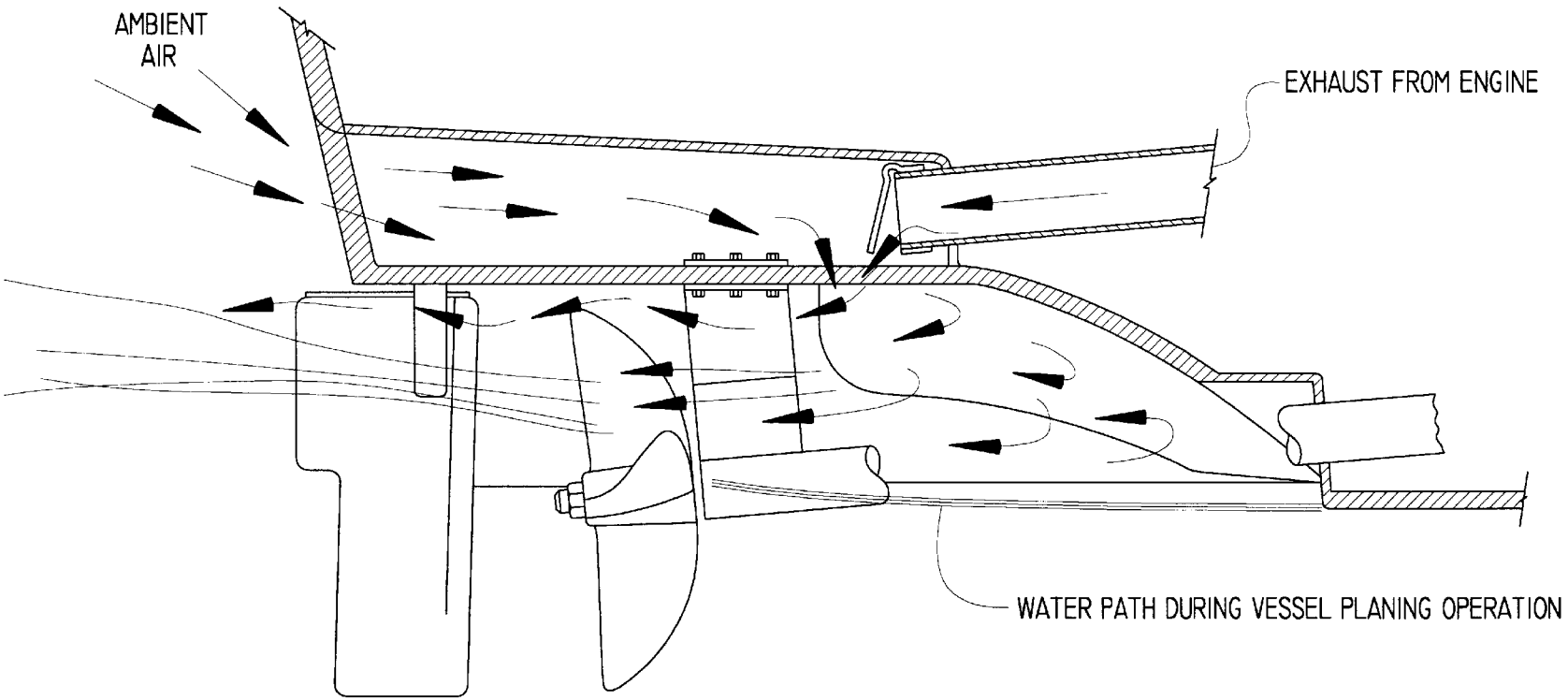

As further illustrated in FIG. 13, the particular placement of the air ingress means enable linearization of the relationship between vessel velocity and engine speed throughout the vessel's operating range.

Figure 8:
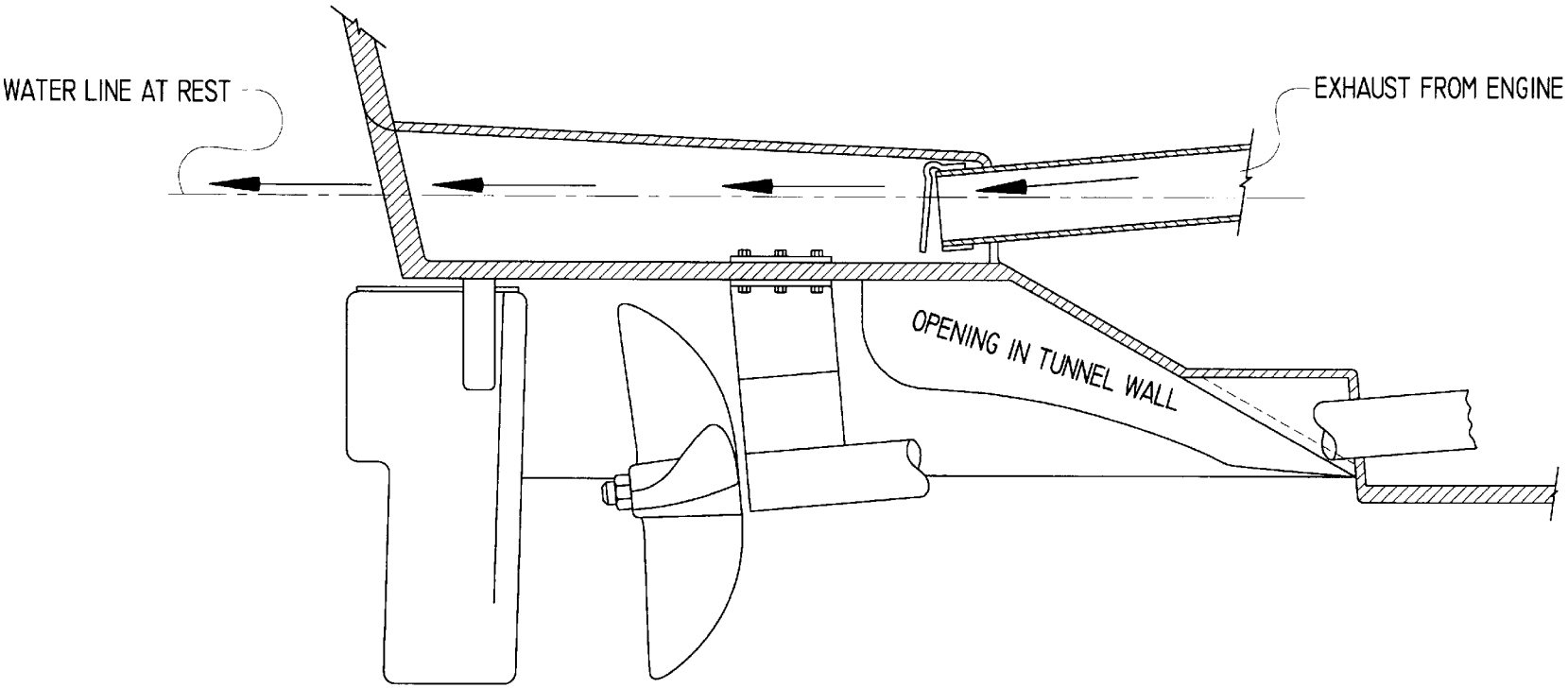
FIGS. 8–13 are a series of cross-sectional views which depict the relationship between the water level and air supply to the propeller during various operating conditions.

Now referring to FIG. 8, a vessel 80 is shown at rest with the engine operating. The water line 82 is positioned such that engine exhaust 84 flows rearwardly and the main air ingress opening 86 is covered by water. The surfacing propeller 88 is submerged below the water line.

Figure 9:
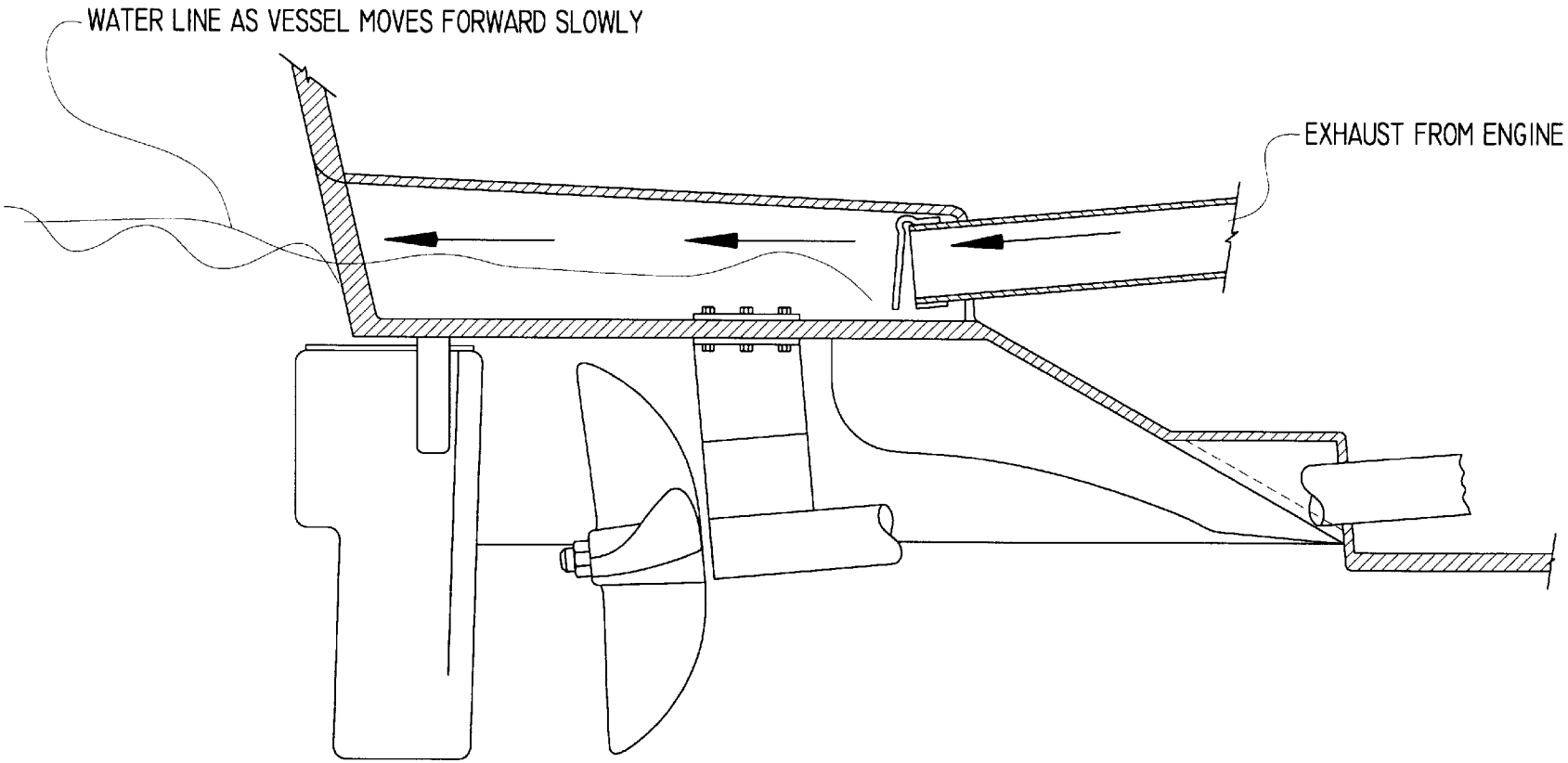

Referring to FIG. 9, the vessel 80 is depicted as having its engine in gear and at idle speed. The water line 82 undulates with the forward movement of the vessel, opening 86 remains covered by water and propeller 88 remains fully submerged.

Figure 10:
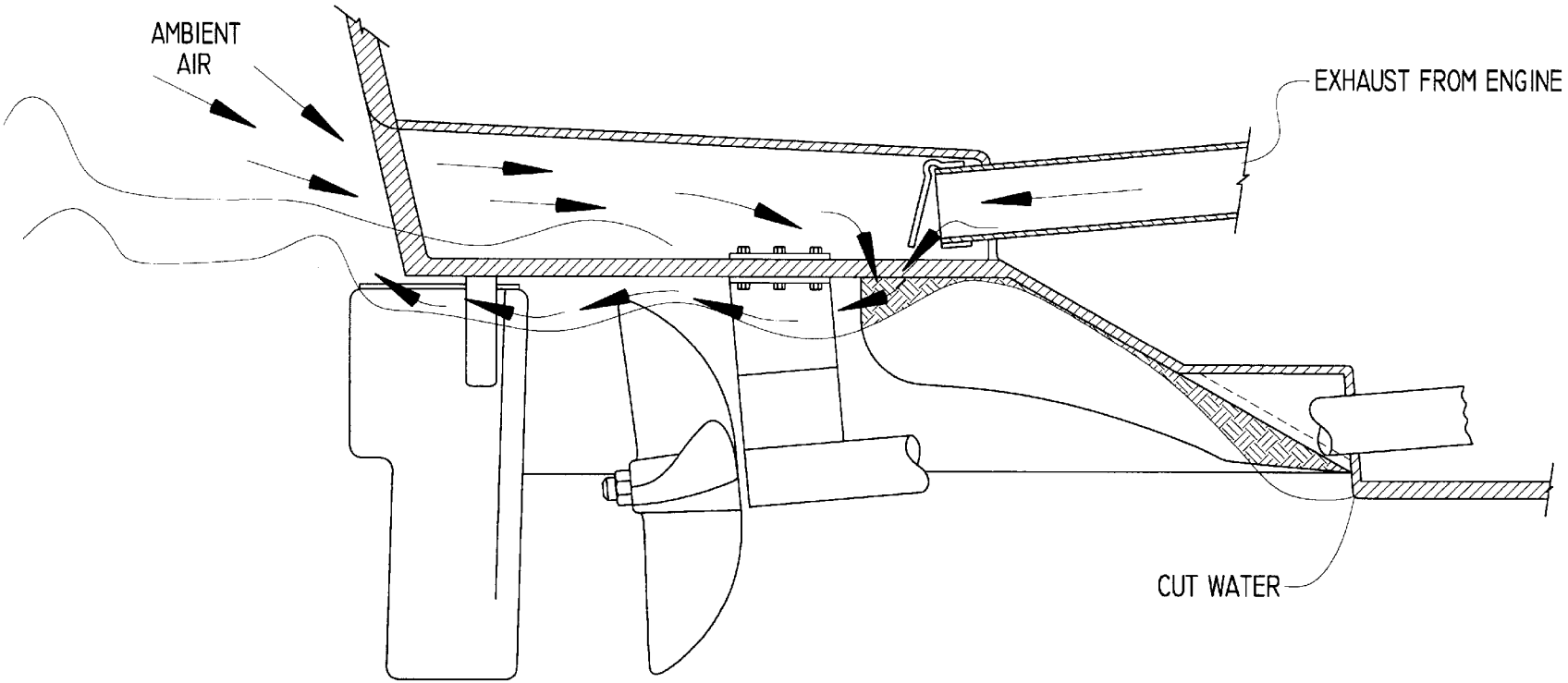

With reference to FIG. 10, the vessel 80 is depicted as having its engine running and in gear and power is being applied in an amount sufficient to transition the vessel to a planing mode. This is signified by the vessel rising in the water and water begins to break loose at the cutwater. At this juncture, the water line 82 has dropped to a point at which the propeller 88 is only partially submerged and is transitioning to a surfacing propeller. The propeller's RPM increases, ambient air is drawn through the air ingress 86, which is now only partially inhibited by water, and the engine exhaust is being drawn into and consumed by the prop wash. This reduces the smoke, sound and smell of engine operation.

Figure 11:
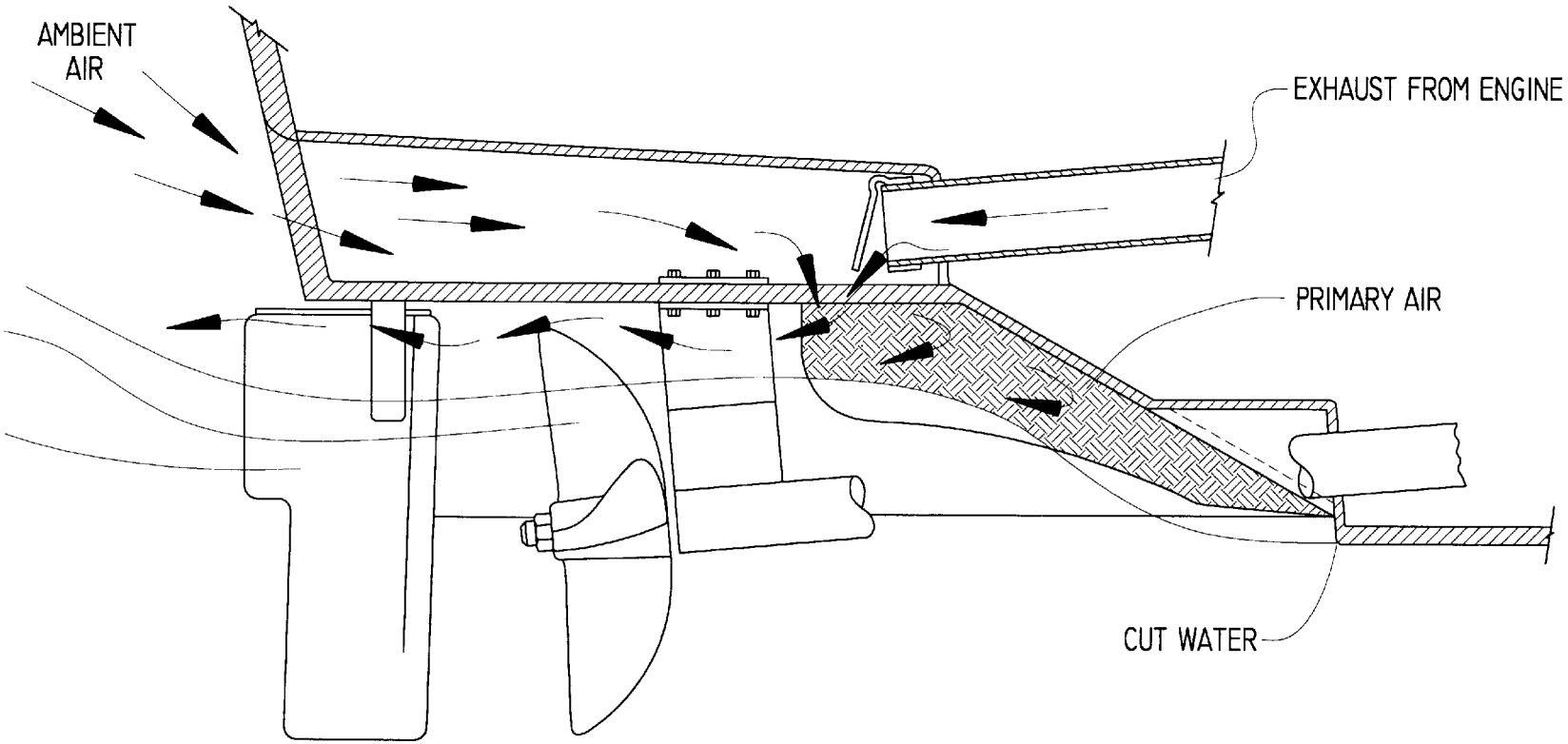

As seen in FIG. 11, the vessel 80 is depicted as accelerating with a heavy load and a velocity in the range of about 15–30 MPH. Water has broken lose and is cutting clean at the cutwater. The air ingress 86, is still partially inhibited by water, enabling the propeller 88 to remain deeply submerged, albeit in a surfacing mode, which enables the greatest thrust to be attained.

Figure 12:
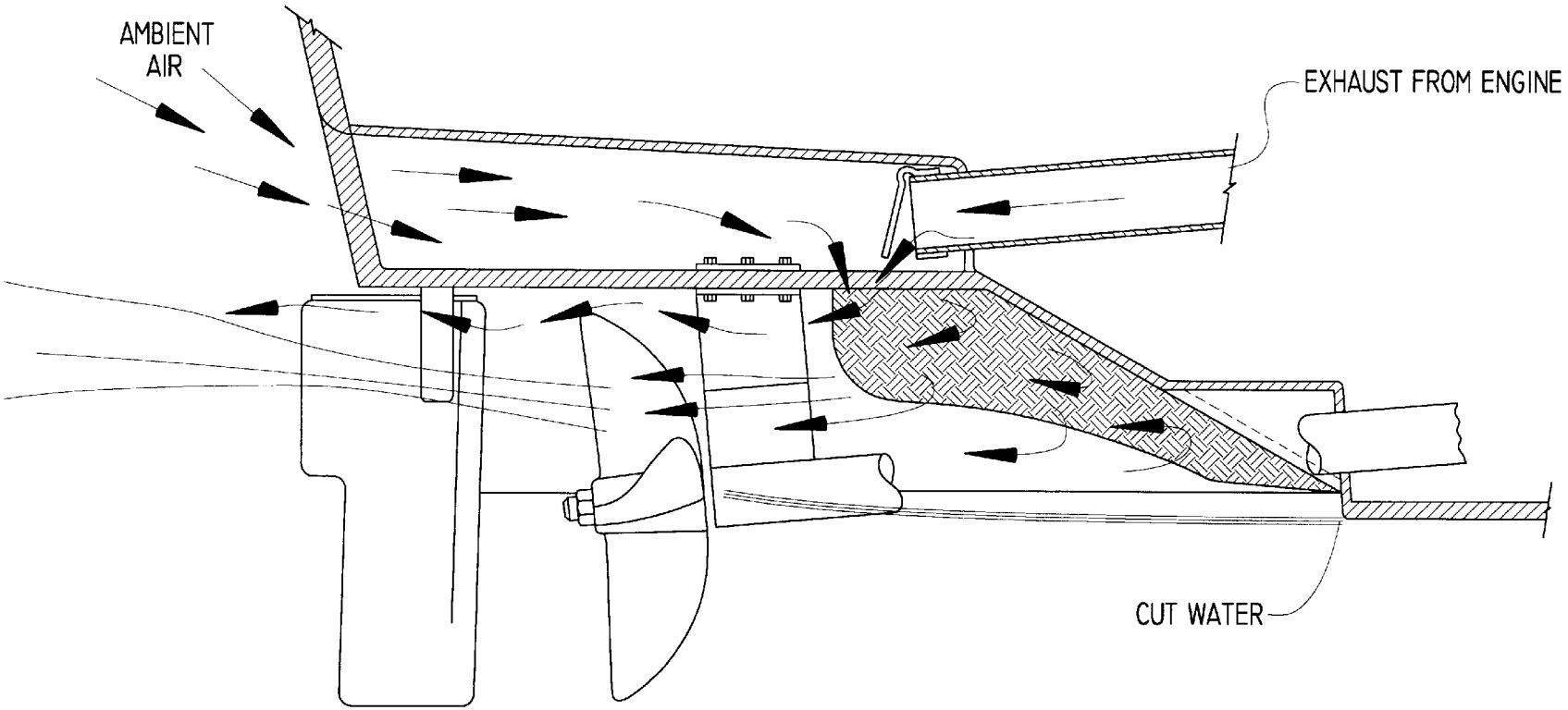

FIGS. 12 and 13 illustrate alternative hull designs depicted in full speed operation. The figures illustrate the water level 82 as it is positioned during high speed operating conditions. As the hull rises, the vessel 80 will have achieved its maximum velocity, in the range of about 35–75 MPH. The vessel has now risen to a point where the water is breaking clean at the cutwater. The air ingress opening 86 is fully uncovered by water and maximum air is being supplied to the propeller 88, which is now in its most efficient surfacing position.

Figure 14:
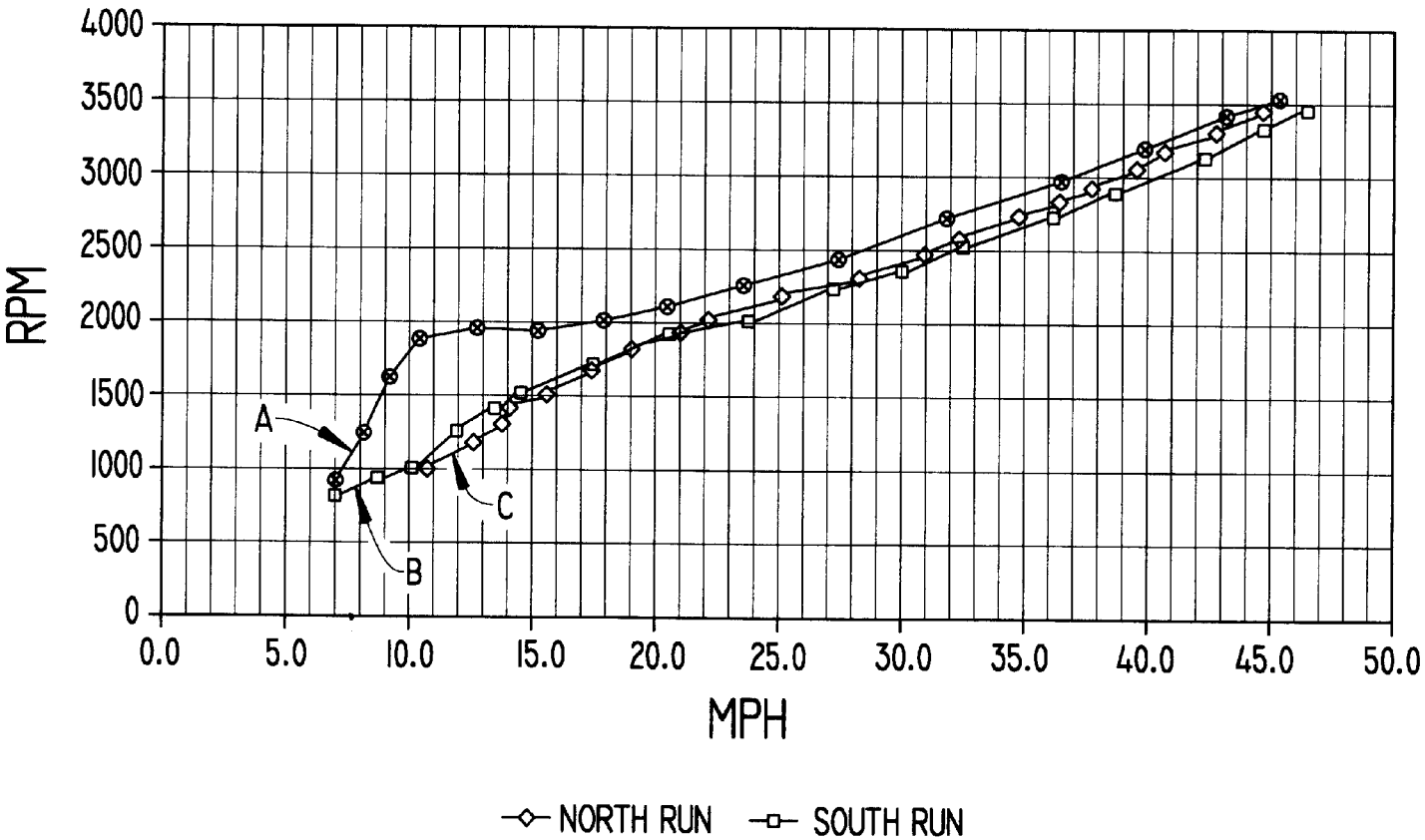
FIG. 14 is a graph of the relationship between engine speed and velocity.

FIG. 14 is a graph of the engine RPM versus velocity in MPH. Line A describes a typical RPM vs MPH relationship for a vessel, e.g. a Sea Ray cruiser, incorporating propeller tunnels absent the air ingress means as instantly described. Lines B and C illustrate a vessel operated with an air ingress opening in accordance with the teachings of the instant invention. With reference to Line A, initially, the RPM rises quickly, although velocity does not change significantly, resulting in a fairly steep slope. As the vessel transitions from displacement to planing operation, in about the 10–25 MPH range, the slope becomes nearly flat, as the RPM remains at approximately 2000. Increased engine speed can not be achieved as the vessel struggles to lift from the water. Upon achieving a planing configuration, the slope again changes, signaling a greater increase in velocity with increasing engine speed. This flattening of the power curve, as the boat lifts from "the hole" to achieve planing operation has been accepted as conventional operation prior to the instant invention.

Now referring to lines B and C (which represent a vessel being operated on a reciprocal course during these tests) judicious placement of the air ingress opening, in accordance with the present invention, so as to provide differing degrees of air to the surfacing propeller during the normal course of acceleration from "at rest" to "maximum velocity" enable the instant inventor to achieve a nearly linear relationship between RPM and MPH throughout the operating range. Contrary to previously accepted theory, the inefficiencies of transitioning from displacement to planing operation, which have historically resulted in a significant hump in the power curve, have now been eliminated.

This is accomplished by appropriate placement of the air ingress opening in a particular vessel's propeller tunnel, such that 1)little or no air is initially provided to the water passing over the submerged surfacing propeller; 2)followed by a period where a portion of the opening becomes uncovered as the propeller begins to transition to surfacing mode; and 3) culminating in a configuration wherein the propeller, running in its most efficient surfacing mode, is supplied with a maximum volume of air. The smooth acceleration resulting from this combination of elements yields an efficiency of operation which has heretofore been unachievable.

FIG. 15 is a chart of air ingress optimization characteristics with references made to figures A and B. The chart provides optimization by way of example. For instance Figure B reference to the feature 40 illustrates that if feature 40 is too small, the tunnel VAC at Wide Open Throttle is high, acceleration is slow, WOT mph is slow, and the engine will overload in rough seas. However, when the feature 40 is correctly sized, the tunnel VAC is proper, acceleration is good, WOT mph is good, and there is no engine overload in rough seas. Figure A and B reference to feature 30 illustrates that if feature 30 is missing, the tunnel VAC has little effect but acceleration is poor. If feature 30 is correctly sized, the tunnel VAC is improved, the acceleration is good and the WOT mph is improved. Figure A and B reference to feature 44 illustrates that if feature 44 is missing, the tunnel VAC has little effect and acceleration is poor. If feature 44 is correctly sized, the tunnel VAC is has no effect but acceleration is good.

Figure A and B reference to feature 42 illustrates that if feature 42 is too small, the tunnel VAC is high, acceleration is poor, WOT mph is low, and the engine may be overloaded in rough seas. When feature 42 is properly sized, the tunnel VAC is correct, the acceleration is good and the WOT mph is good.

Figure A and B reference to feature 34 illustrates that if feature 34 is too small acceleration is poor, WOT mph is good but the engine may be overloaded in rough seas. When feature 34 is properly sized, the tunnel VAC is correct, the acceleration is good and the WOT mph is good.

Figure A reference to dimension Y illustrates that if feature Y is too small the acceleration is poor but WOT mph is excellent. If feature Y is too large, acceleration has no effect and WOT mph is poor. If feature Y is sized correctly, the acceleration is good and the WOT mph is good.

Figure A and B reference to area 14 illustrates that if area 14 is too small, acceleration is poor and WOT mph is poor.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. In an engine driven marine vessel having a hull and at least one engine driven surface piercing propeller positioned within a tunnel formed integral with said hull of said vessel, said tunnel having at least one surface which runs generally parallel to a longitudinal axis of said vessel and is contiguous with a bottom side of said hull and a top side of said tunnel comprising: an air ingress opening positioned within said surface of said tunnel for providing ventilation air to said tunnel.

2. The marine vessel according to claim 1, wherein said air ingress opening is constructed and arranged to provide ventilation air to said tunnel at an increased volume as a function of forward velocity of said vessel.

3. The marine vessel according to claim 1, wherein exhaust from said engine communicates with said tunnel.

4. The marine vessel according to claim 1, wherein the air ingress opening is particularly positioned to maintain a linear relationship between vessel velocity and engine speed.

5. A method of optimizing an air ingress opening in an engine driven marine vessel having a hull and at least one engine driven surface piercing propeller positioned within a tunnel formed integral with said hull of said vessel, said tunnel having at least one surface which runs generally parallel to a longitudinal axis of said vessel and is contiguous with a bottom side of said hull and a top side of said tunnel comprising the steps of: calculating an optimum position for placement of an air ingress opening; locating a air ingress opening in said tunnel, and providing a chamber for carrying air to said air ingress opening.

6. The method of optimization according to claim 5, wherein said air ingress opening is constructed and arranged to provide ventilation air to said tunnel at an increased volume as a function of forward velocity of said vessel.

7. The method of optimization according to claim 5, including the step of providing an exhaust exit into said tunnel, said exhaust exit positioned to provide uninhibited exit from said tunnel at low speeds and provide air ventilation in combination with said air egress opening at operating speeds.

8. The method of optimization according to claim 5 including the step of positioning said air ingress opening to maintain a linear relationship between vessel velocity and engine speed.

9. The method of optimization according to claim 5 wherein including the step of shaping said air ingress opening to maintain a linear relationship between vessel velocity and engine speed.

* * * * *